US006655016B2

(12) United States Patent
Renaud

(10) Patent No.: US 6,655,016 B2
(45) Date of Patent: Dec. 2, 2003

(54) PROCESS OF MANUFACTURING A SHIELDED AND WEAR-RESISTANT MULTI-BRANCH HARNESS

(75) Inventor: Thierry Jean-Pierre Renaud, La Fare les Oliviers (FR)

(73) Assignee: Societe Anonyme dite: Eurocopter France, Marignane Cedex (FR)

( * ) Notice: Subject to any disclaimer, the term of this patent is extended or adjusted under 35 U.S.C. 154(b) by 14 days.

(21) Appl. No.: 09/820,361

(22) Filed: Mar. 29, 2001

(65) Prior Publication Data

US 2001/0011601 A1 Aug. 9, 2001

Related U.S. Application Data

(62) Division of application No. 08/572,166, filed on Dec. 13, 1995, now Pat. No. 6,255,584.

(30) Foreign Application Priority Data

Dec. 13, 1994 (FR) ..... 94 14968

(51) Int. Cl.[7] ..... H01R 43/00

(52) U.S. Cl. ..... 29/825; 29/828; 29/33 F; 174/36; 174/71 R; 174/72 R

(58) Field of Search ..... 29/825, 828, 33 F, 29/854; 174/36, 72 A, 103, 106 R, 71 R, 72 R, 35 R, 2

(56) References Cited

U.S. PATENT DOCUMENTS

| | | | | |
|---|---|---|---|---|
| 319,326 A | | 6/1885 | Sawyer | |
| 2,047,152 A | | 7/1936 | Mitchell | |
| 2,277,177 A | | 3/1942 | Wermine | |
| 3,843,829 A | | 10/1974 | Bridges et al. | |
| 3,984,622 A | | 10/1976 | Ross | |
| 4,376,229 A | | 3/1983 | Maul et al. | |
| 4,640,178 A | | 2/1987 | Kurzbock | |
| 4,677,371 A | | 6/1987 | Imaizumi | |
| 4,678,865 A | | 7/1987 | Sherwin | |
| 4,731,500 A | | 3/1988 | Otsuka | |
| 4,822,956 A | | 4/1989 | Sepe | |
| 5,012,045 A | | 4/1991 | Sato | |
| 5,091,604 A | * | 2/1992 | Kirma | 174/2 |
| 5,115,105 A | | 5/1992 | Gallusser et al. | |
| 5,295,868 A | | 3/1994 | Viaud et al. | |
| 5,349,133 A | | 9/1994 | Rogers | |
| 5,378,853 A | * | 1/1995 | Clouet et al. | 174/36 |
| 5,414,211 A | * | 5/1995 | Chan | 174/36 |
| 5,414,212 A | | 5/1995 | Clouet et al. | |
| 5,475,185 A | * | 12/1995 | Tokarsky | 174/36 |

FOREIGN PATENT DOCUMENTS

| | | |
|---|---|---|
| EP | 0397063 A3 | 11/1990 |
| FR | 0691007 A1 | 11/1993 |

* cited by examiner

*Primary Examiner*—Richard Chang
(74) *Attorney, Agent, or Firm*—Stevens, Davis, Miller & Mosher, LLP

(57) ABSTRACT

A process for the production of a multi-branched bundle of electrical conductors having an electromagnetic shielding system includes partially surrounding a bundle of electrical conductors with a network of metal sheath elements. The metal sheath elements are interconnected to provide electrical continuity in the network and thereby form an electromagnetic shielding system for the bundle. A network of protective braid elements is braided either (i) between the bundle and the network of metal sheath elements, (ii) external to the network of metal sheath elements, or (iii) both (i) and (ii). The protective braid elements are filaments of a wear-resistant material that protect against frictional wear.

3 Claims, 4 Drawing Sheets

PROCESS OF MANUFACTURING A SHIELDED AND WEAR-RESISTANT MULTI-BRANCH HARNESS

This is a division Ser. No. 08/572,166, filed Dec. 13, 1995 , now U.S. Pat. No. 6,255,584.

BACKGROUND OF INVENTION

1. Field of Invention

The present invention relates to electrical conductor bundles, especially those called harnesses, which are hardened, that is to say shielded against electromagnetic disturbances, and which are intended to electrically connect together the various items of equipment of a complex electrical installation, the correct operation of which must be ensured, even in the case of electromagnetic disturbances. Such harnesses are, for example, used on board aircraft, ships, battle tanks, etc. The present invention also relates to a process for the production of such a bundle or harness.

2. Description of Related Art It is known that these harnesses consist of a bundle of conductors which may or may not be stranded and are divided up into several sub-bundles or branches, starting from branching nodes arranged along said bundle, and of connectors arranged on the free ends of said branches.

In order to shield them against electromagnetic disturbances, said harnesses are coated with metal sheath elements completely covering said conductors. However, such a shielding sheath has the drawback, especially due to the effect of the vibrations to which said harness are subjected, of exerting an abrasive action on the objects in contact with it. Thus, it may wear away the electrical insulation covering the conductor, which said shielding sheath surrounds, or else wear away the shielding sheath of another harness (or vice versa). It is obvious that such an abrasive action may lead to undesirable malfunctions of the installations having said harnesses.

SUMMARY OF THE INVENTION

The object of the present invention is to remedy this drawback.

For this purpose, according to the invention, the multi-branched bundle of electrical conductors, provided with an electromagnetic shielding system which consists of a network of metal sheath elements surrounding said conductors and providing the electrical continuity of said shielding system, is noteworthy in that it includes at least one network of braid elements braided directly on said bundle using filaments of a wear-resistant material, so that said network of braid elements forms a protection against frictional wear liable to be exerted by said metal sheath elements.

Thus, said braid elements form a protection against the abrasive action of the metal sheath elements.

In order to protect the electrical conductors of the bundle against said sheath, such braid elements may be arranged between said conductors and said metal sheath elements.

Moreover, as a variant or in addition to the above braid elements, other braid elements may be provided which are arranged on the external surface of said metal sheath elements.

Thus, this metal sheath is prevented from exerting a wearing action on the objects with which it may be in contact and vice versa.

It will be noticed that, when a sealing product is applied to said bundle (as is usually the case), it is advantageous to do so after producing said braid elements, which then serve as reinforcement for said sealing product.

Although the filaments making up the said braid elements may be of any type, as long as they withstand the abrasive action of the metal sheath, it is preferable for these filaments to be made of a synthetic material, especially a heat-fusible material.

Thus, it is possible to secure, by partial melting, at least one of the ends of said braid elements so as to prevent unbraiding after producing said braid elements on the bundle.

For the braiding, said filaments may be in the form of a twisted or untwisted yarn or a filament roving.

Moreover, the present invention also relates to a process for the production of a multibranched bundle of electrical conductors provided with an electromagnetic shielding system which consists of a network of metal sheath elements surrounding said conductors and providing the electrical continuity of said shielding system. This process is noteworthy in that produced on said bundle is a protection against the frictional wear liable to be exerted by said metal sheath elements and in that said protection is obtained by the braiding, directly on said bundle, of at least one network of braid elements consisting of filaments of a wear-resistant material.

In a known manner, said electrical conductor bundles generally include nodes each joining three branches of said bundle. In this case, at each of said nodes, three braid elements are formed, each of them leading from one of the three branches to one of the other two, the other of said other two branches passing laterally through it and the pair of branches carrying each of said three braid elements is different from the pairs of branches carrying the other two braid elements.

In the particular case where these three branches have different cross sections, it is advantageous to start by producing a first braid element carried by the two branches having respectively the smallest and the largest cross section, and then a second braid element carried by the two branches having respectively the intermediate cross section and the smallest cross section, and finally a third braid element carried by the two branches having respectively the intermediate cross section and the largest cross section.

In addition, said first, second and third braid elements may cover, respectively, all of said branch having the smallest cross section, all of said branch having the intermediate cross section and all of said branch having the largest cross section and, partially, in the vicinity of said node, said branch having the largest cross section, said branch having the smallest cross section and said branch having the intermediate cross section.

In contrast, when two of the three branches have cross sections which are at least approximately equal, it is advantageous for one of said braid elements to cover, continuously, all of said two branches.

In order to produce such a braid element, it is possible to start by forming a free braiding tail, after which said braiding tail is laid against one of said branches of the bundle which is to carry said braid element and the braiding of said braid element is started on this latter branch.

Likewise, it is possible to end a braid element with an empty braiding tail which is laid against that one of said branches carrying said braid element, on which said braid element stops.

Thus, said braiding tails may serve to secure the beginning and/or the end of said braid elements in position on the electrical conductor bundle. For this purpose, it is sufficient to provide rings or the like in order to fix said braiding tails to the bundle. As an alternative, some of the braiding tails may be secured in position by one of the braid elements which covers them.

In order to achieve self-securing of a braid element in position, it is possible, at the beginning of the production, to start the braiding at the corresponding node, working away from it before reversing the direction of advance of the braiding in order to move back toward said node and covering the beginning of the braid element already formed and said braiding tail, so as to form a hem which positionally immobilizes said braiding tail.

Preferably, when an electrical connector is mounted on the end of one of said branches, said braid element is started with a hem, as described hereinabove, on the end-piece of said connector, through which end-piece said branch enters said connector.

In the particular case where the electrical conductor bundle is in the form of a harness having a progressively narrowing main trunk with nodes from which said branches branch off, said braid elements are preferably produced starting with the thinnest branches and ending with the thickest branches.

However, in order to benefit from an already existing adjustment of the braider producing said braid elements and thus to decrease the total braiding time, when close but not necessarily consecutive branches have approximately equal cross sections, the braiding of the corresponding braid elements is carried out consecutively.

BRIEF DESCRIPTION OF THE DRAWINGS

The figures of the appended drawing will clearly show how the invention may be realized. In these figures, identical references designate similar elements.

DETAILED DESCRIPTION OF THE PREFERRED EMBODIMENTS

Figure 1:
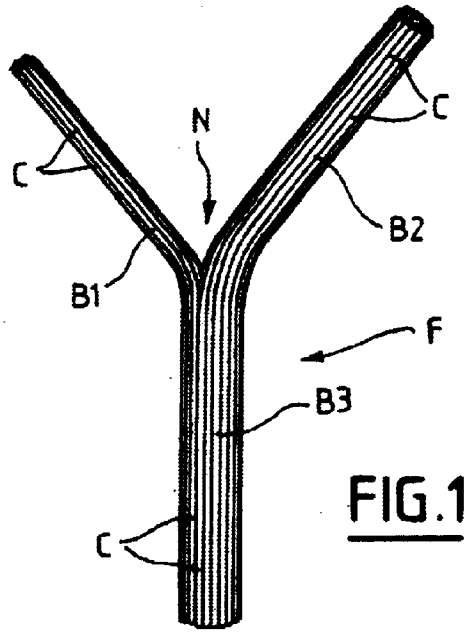
FIG. 1 shows a portion of an electrical conductor bundle, in the vicinity of a node connecting three branches.

FIG. 1 shows a portion of a bundle F of electrical conductors C, which may or may not be stranded, in the vicinity of a node N connecting three branches B1, B2 and B3 of said bundle F.

Figure 2:
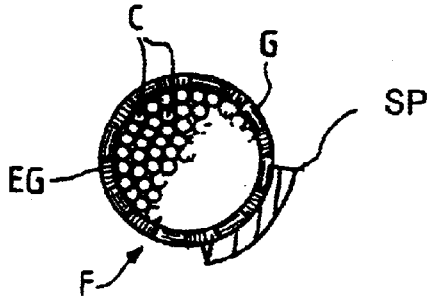
FIG. 2 shows, in cross section and on a larger scale than FIG. 1, a known electrical conductor bundle provided with a metal electromagnetic shielding sheath.

In the usual manner, as shown in cross section in FIG. 2, in order to harden said bundle F, each branch of the latter is surrounded by a metal sheath G element EG protecting the corresponding conductors C from external electromagnetic disturbances.

Such metal sheath elements EG may be produced beforehand in the form of braid portions and then slipped over said branches B1, B2 and B3 and finally electrically connected to one another by sleeves, for example heat-shrinkable sleeves, at the nodes N, so as to provide the electrical continuity of said metal sheath G. As a variant, each metal sheath element EG may be braided directly on each of said branches B1, B2 and B3 and include an extension onto another branch, serving to provide the electrical continuity of the sheath. For the latter purpose, overbraidings may also be provided at the nodes N.

In whatever way the braid is produced on the bundle F, such a metal sheath G element EG exerts an abrasive action, on the one hand, on the external insulation of the conductors C lying at the periphery of the bundle F, in contact with the element EG, and, on the other hand, on the objects, external to said bundle (for example other bundles), lying in contact with said braid element EG. This abrasive action is all the greater if said bundle is subjected to vibrations and if said sheath G is in the form of a braid and, consequently, if its surface is not smooth.

As was explained above, the object of the present invention is to remedy the effects of just such an abrasive action by the metal electromagnetic protection sheath G.

Figure 3:
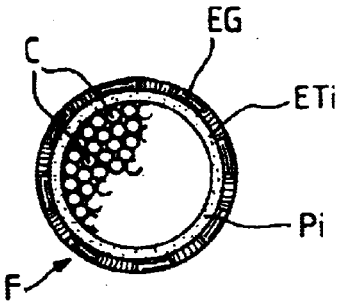
FIGS. 3, 4 and 5 illustrate respectively, in cross sections similar to that in FIG. 2, three embodiments for the electrical conductor bundle in accordance with the present invention.
Figure 4:
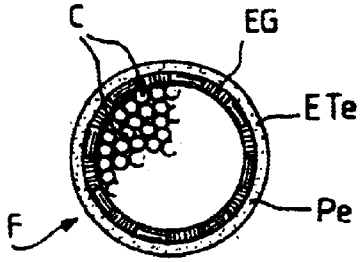
Figure 5:
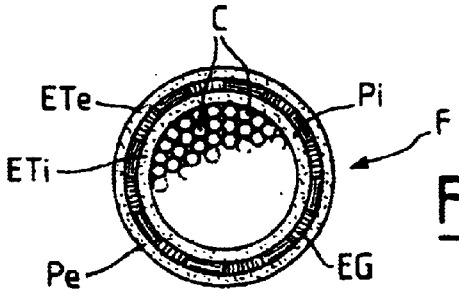

To do this, as shown in FIGS. 3 to 5, braid elements ETi and/or ETe are provided on the branches B1, B2, B3, these elements forming together a network making up a protection Pi or Pe against the abrasive action of the sheath elements EG.

In the embodiment in FIG. 3, the braid elements ETi are interposed between the conductors C of the bundle F and the sheath elements EG of the electromagnetic shielding sheath G. The braid elements ETi form an internal protection Pi and therefore protect the conductors C from the abrasive action of the sheath elements EG.

In the embodiment in FIG. 4, the braid elements ETe are arranged on the external surface of the sheath elements EG. The braid elements ETe form an external protection Pe and therefore protect, from the abrasive action of the sheath elements EG, external objects (for example other conductor bundles) liable to be in contact with the outer periphery of said sheath elements EG and vice versa.

The embodiment in FIG. 5 includes both braid elements ETi forming an internal protection Pi and braid elements ETe forming an external protection Pe.

The braid elements ETi and ETe consist of filaments of a material capable of withstanding the abrasive action of the sheath elements EG, such as a composite material, an aramid fiber, etc.

According to an important characteristic of the present invention, the braid elements ETi and ETe are braided directly on the branches of said bundle F, for example by means of a braider. To do this, said elements form yarns (which may or may not be twisted) or rovings capable of being braided around the branches of said bundle.

As is apparent from the above explanations, especially with regard to FIGS. 6A to 6E, the braid elements ETi or ETe are produced branch by branch, partially covering another branch, so as to cover all of the nodes N satisfactorily.

One possible embodiment of the braid elements ETi and/or ETe on the bundle F, at the node N, will now be described with the aid of FIGS. 6A to 6E. Since the braid elements ETi are produced in the same manner as the braid elements ETe, the braid elements ET1, ET2 and ET3 in FIGS. 6A to 6E represent either elements ETe or elements ETi depending on whether or not the bundle F in FIG. 6A includes elements EG forming an electromagnetic protection sheath G.

Figure 6A:
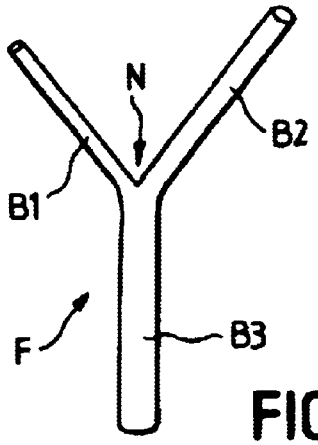
FIGS. 6A to 6E diagrammatically illustrate various steps in a possible implementation of the process for producing protective braid elements at the node in FIG. 1, in accordance with the present invention.

Moreover, in the example in FIG. 6A, it is assumed that the portion of bundle F has branches B1, B2 and B3 of unequal cross sections, the branch B1 having the smallest cross section and the branch B3 the largest.

Figure 6B:
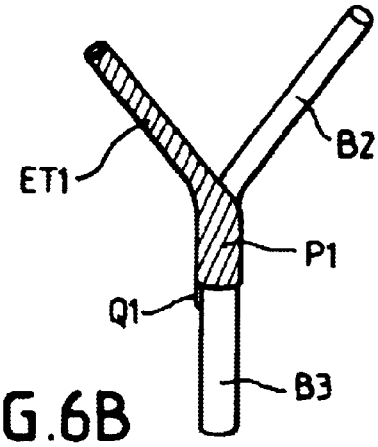

As illustrated in FIG. 6B, the initial step in this example is to produce a free braiding tail Q1 (the bundle F not being placed in the braider) which is cut to the desired length, preferably by burning, especially when the braiding filaments are made of a heat-fusible synthetic material. Thus, said tail Q1 is prevented from unbraiding.

Next, the bundle F is placed in the braider and the braiding tail Q1 is put flat against the branch B3. A braid element ET1 is then produced, following on from said braiding tail Q1 and working toward the node N, which braid element includes a part P1 covering the branch B3 in the vicinity of the node N and completely covers the branch B1. This braid element ET1 is produced so that the branch B2 passes through it laterally, where it joins the node N. The braiding parameters (the number of strands braided, the number of reels delivering said strands and the braiding pitch) are adjusted so that said braid element ET1 and its part P1 cover, without any gaps or overlapping, all of the branch B1 and part of the branch B3 respectively. Since it is assumed that the branch B1 has a smaller cross section than the branch B3, it may be seen that it is necessary for the braiding pitch on the branch B3 (part P1) to be smaller than on the branch B1.

In a manner similar to that described hereinabove with regard to the braid element ET1, the braiding of the bundle F element (see FIG. 6C) is continued by forming a free braiding tail Q2 which is laid against the braid element ET1, in the vicinity of the node N, and then by producing a braid element ET2 which includes a part P2 covering the braid element ET1 (that is to say the branch B1) in the vicinity of said node N and which completely covers the branch B2. The branch B3, partially covered with the braiding part P1, passes through the braid element ET2 laterally where it joins the node N. Of course, because of the cross section ratios given by way of assumption, the braiding pitch of the element ET2 is larger on the branch B1 than on the branch B2.

Next, using the same technique as above, a free braiding tail Q3 is formed which is laid against the braid element ET2 in the vicinity of the node N, and following on from which a braid element ET3 is produced which includes a part P3 covering the braid element ET2 (branch B2) in the vicinity of said node and which completely covers the branch B3. The branch B1, covered with the braid element ET1 and with the braiding part P2, passes through the braid element ET3 where it joins the node N. The braiding pitch on the branch B2 is larger than on the branch B3.

The braid element ET3 covers the braiding tail Q1 of the braid element ET1 and secures it in position. Preferably, the braiding tails Q1 and Q3 are themselves secured in position by rings f2, f3 respectively surrounding the branches B1 and B2 and covered with a varnish, preventing them from coming undone due to the effect of vibrations.

The embodiment of the invention illustrated by FIGS. 6B to 6E is only one example of braiding, from among others, which takes into account the differences in cross section of the branches B1, B2 and B3. An indication of alternative embodiments will be given below with regard to FIGS. 7 to 11.

Figure 7:
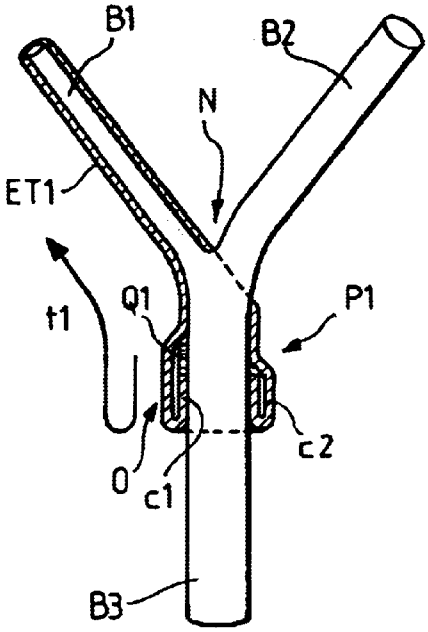
FIGS. 7 and 8 illustrate alternative embodiments of the braid elements.

FIG. 7 shows, regarding the braid element ET1, an alternative embodiment of the start of the braiding of the protective braid elements.

Figure 6C:
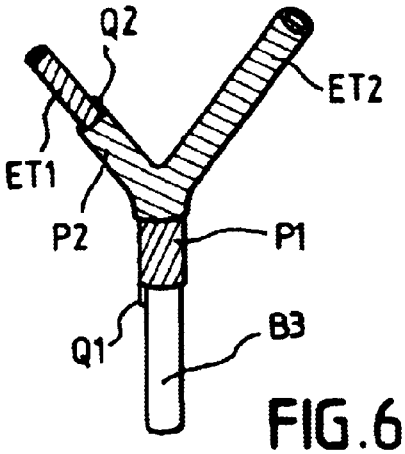
Figure 6D:
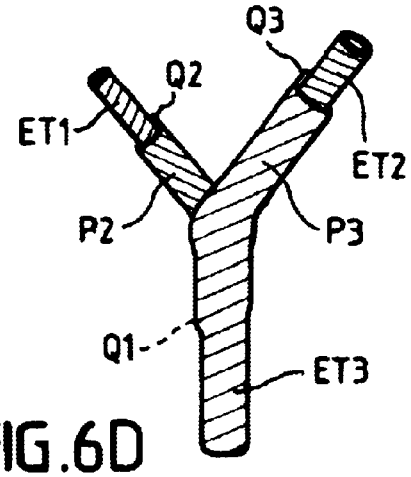
Figure 6E:
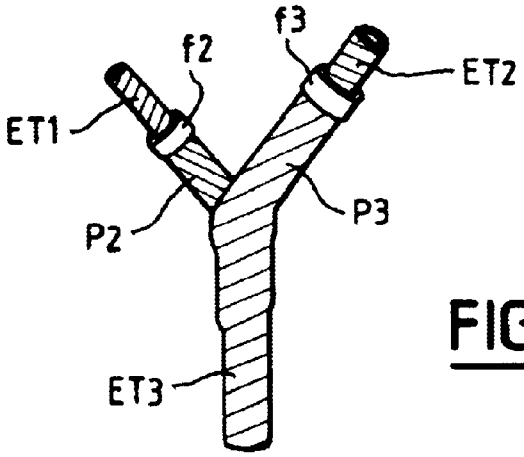

As may be seen in this FIG. 7, the braiding tail Q1 is arranged flat against the branch B3 so that the beginning of braiding of the part P1 following on from the tail Q1, instead of being carried out in the direction of the node N, as shown in FIGS. 6B to 6D, is, on the contrary, carried out over a certain length of the branch B3, working away from said node, so as to form an inner first ply c1. Next, the direction of advance of the braiding is reversed in order to move back toward the node N (the direction of the braiding and its reversal are represented by an arrow t1). This results in the braiding of an outer second ply c2, which covers the inner ply c1 and the tail Q1, and the formation of a hem O. Such a hem keeps the braiding tail Q1 in position and produces a perfect braiding finish. After forming the hem O, the braiding is continued in order to complete the part P1 and to produce the element ET1 on the branch B1.

Figure 8:
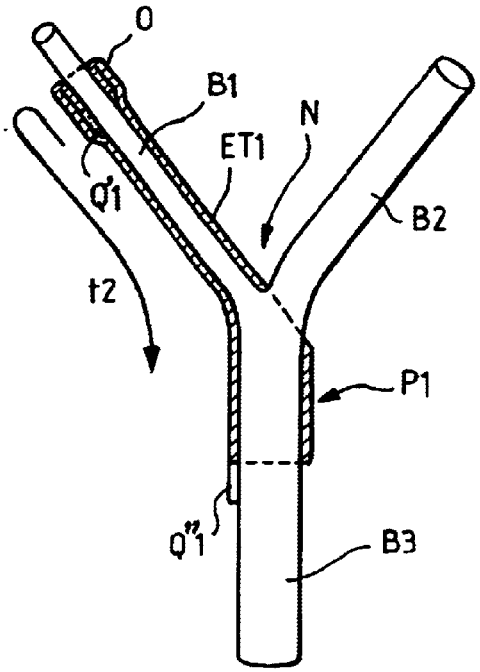

According to another alternative embodiment of the braid element ET1, illustrated in FIG. 8, the braiding of this element may start at the end of the branch B1 opposite the node N, instead of beginning on the branch B3, as described above. It is then advantageous to form a first braiding tail Q'1 which is laid against said branch B1 at some distance from this end, in order to be able to begin the braiding working away from said node N, after which the direction of advance of the braiding is reversed (see arrow t2), in order to form a hem O which will secure said braiding tail Q'1 in position. The braiding of the element ET1 on the branch B1 is continued in the direction of the node N and then extended onto the branch B3 in order to form the part P1. Finally, a second braiding tail Q"1 is formed and laid against said branch B3. It may be fixed thereto by a ring (not shown), similar to the rings f2 and f3 in FIG. 6E.

Figure 9:
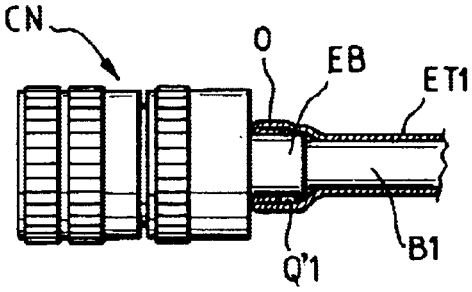
FIG. 9 illustrates the production of a braid element in the vicinity of a connector.

The embodiment in FIG. 8 is particularly advantageous when a connector CN is mounted on the end of said branch B1 (as is shown in FIG. 9) during the production of the element ET1. Thus, the hem O, by securing the tail Q'1, may fix the element ET1 to the end-piece EB provided on said connector CN in order to cause the branch B1 to enter the latter. Thus, a braid end is obtained which is capable of withstanding the stresses which are imposed by the frequent manipulations (connection and disconnection) of said connector CN.

Figure 10:
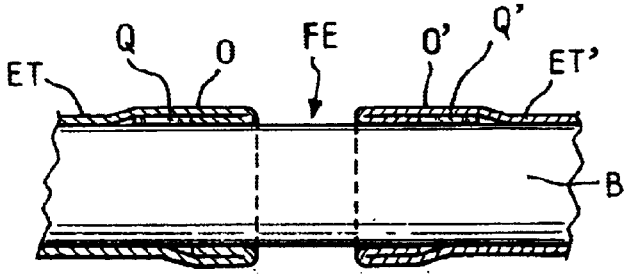
FIG. 10 shows the formation of a break in the protective braiding.

FIG. 10 illustrates that, on a branch B, it is possible to produce a window FE by producing two opposed braid elements ET and ET'. In this FIG. 10, provision has been made for the beginnings of the braiding of the elements ET and ET' to each have a hem O or O', as described with regard to FIGS. 7, 8 and 9. Of course, these braiding beginnings could consist simply of braiding tails, like those in FIGS. 6B to 6D. Such a window FE is particularly advantageous when the braid elements ET and ET' cover a metal sheath G element EG. Thus, said window FE makes it possible to leave open a part of said shielding sheath G, which may be connected to a grounding structure, for example the fuselage of an aircraft (helicopter).

Figure 11:
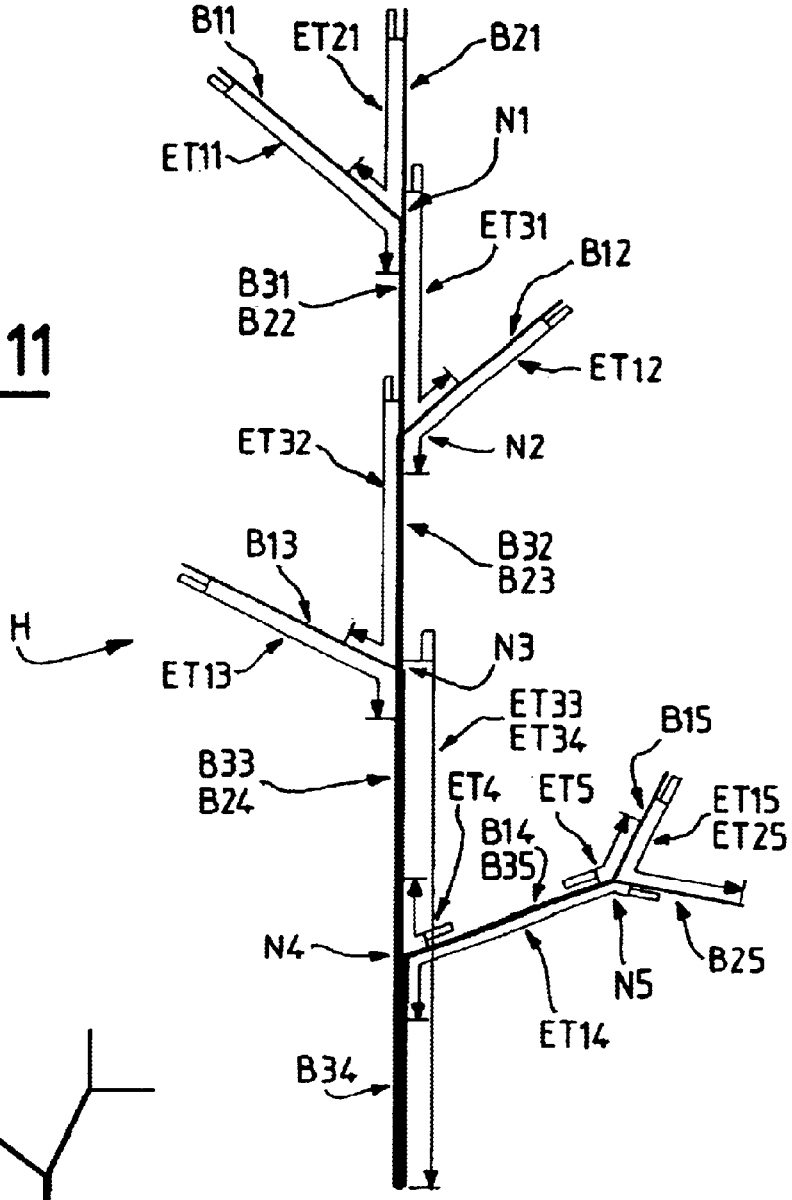
FIG. 11 illustrates one possible embodiment of the present invention for protecting a conductor harness by producing protective braid elements, in accordance with the present invention.

The harness H, shown in FIG. 11, represents a particular case of a conductor bundle F in which the conductors C form a main trunk, from the nodes of which branches branch off. In the example in FIG. 11, the harness H includes five nodes Ni (i=1, 2, 3, 4 or 5) and the branches leaving or arriving at a node Ni bear the references B1i, B2i and B3i.

In FIG. 11, arrows have been shown which symbolize the braiding direction: the tail end of an arrow marks the start of braiding and the tip of an arrow indicates the branch braided and the point where the braiding ends. The thickness of the lines of the branches of the harness symbolizes the cross sections of the various branches.

Although not shown, connectors CN are connected on the free ends of the branches and the embodiment of the braid elements is that in FIGS. 8 and 9, namely the braiding starts by forming a hem O on the end-piece EB of the corresponding connector and the braiding stops with the braiding tail, preferably secured in place by a ring.

The protection of the harness H in FIG. 11 is formed by progressing from the branches of smaller cross sections to the branches of larger cross sections, implementing the particular node-covering cases illustrated in the FIGS. 6B to 6D.

Thus, the initial step is to produce the braid element ET11 which starts on the terminal branch B11 of smaller cross section and terminates on the branch B31 (which corresponds to branch B22 of the node N2). Next, the braid element ET21 is produced, this starting on the branch B21, having a cross section greater than the branch B11 but less than the branch B31, and terminating on the branch B11.

If the branch B12 has the same cross section as the branch B21 (that is to say the braiding parameters are the same for those branches B12 and B21), the braid element ET12 is then produced, covering the branch B12 and terminating on the branch B32 (which corresponds to the branch B23 of the node N3). The braiding time and the use of the braider are thus optimized by producing thereafter braid elements having the same braiding parameters.

Next, the braid element ET31 is produced (in the manner of the element ET3 in FIG. 6D) by making it start on the branch B21, covering all of the branch B31 (B22) and stopping on the branch B12.

Next, the element ET13 is braided, covering the branch B13 and stopping on B33 (B24), since the branches B31 and B13 are assumed to be similar, followed by the braiding of the element ET32 starting from the branch B31 (B22), covering the branch B32 (B23) and stopping on the branch B33 (B24).

The two branches B15 and B25 are assumed to have the same cross section. It is then possible to produce a short braid element ET5 starting from B14 (B35) in the vicinity of the node N5 and stopping on the branch B15, in the vicinity of N5. The branches B15 and B25 of identical cross section are then covered with a single braid element ET15 (ET25) which starts at the end of the branch B15 and stops at the end of the branch B25.

The branches B33 (B24) and B34 have similar cross sections, which makes it possible to use, on the braider, identical numbers of strands and reels, only the braiding pitch being different. It is then possible to follow the following procedure:

a short braid element ET4 is produced, this starting from the branch B14 (B35) in the vicinity of the node N4 and stopping on the branch B33 (B24), still in the vicinity of the node N4;

the braid element ET14 is produced, this starting on the branch B25, covering the branch B14 (B35) and terminating on the branch B34, in the vicinity of the node N4;

finally, the continuous braid element ET33-ET34 is produced, this starting on the branch B32 (B23) and covering the branches B33 (B24) and B34, passing via the node N4.

Figure 12:
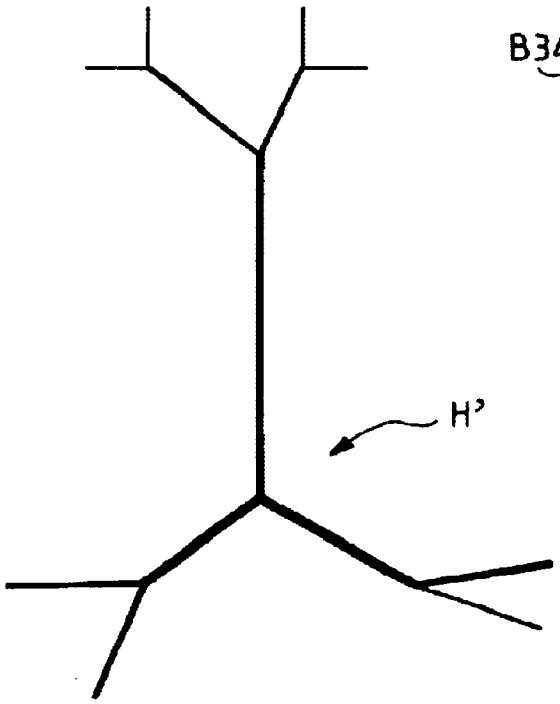
FIG. 12 shows another example of a harness capable of being protected in accordance with the invention.

FIG. 12 shows a harness H' which includes several branches connecting various items of equipment (not shown) and having variable cross sections, but which does not have a main axis serving the various directions.

From the description which has just been given, it will be understood that the harness H' in FIG. 12 may be coated with a braided protection, just like the harness H in FIG. 11.

By virtue of the present invention, it may thus be seen that mechanical protections are produced which protect against the shielding of the harnesses, while at the same time benefitting from an excellent compromise between cost, weight and wear resistance, for, except at the branching nodes, these protections include only a single braiding ply and the braid elements are easy to produce.

In addition, these braid elements form an excellent finishing layer for the harness. They may furthermore serve as a sublayer and reinforcement for a sealing coating applied to the harnesses. The reason for this is that said braid elements might be the site of a wicking effect, propagating the fluids (water, fuel, hydraulic fluid, etc.) which are liable to come into contact with them, something which could be dangerous. This is particularly so, for example, for harnesses arranged at least partly on the outside of the fuselage of an aircraft. Thus, it is advantageous to deposit a sealing product, for example by means of a spray gun, on said braid elements so as to seal said harnesses. Such a sealing product is shown in FIG. 2 as SP. It will be noted that these braid elements then serve to bond the sealing coating strongly to the harness and prevent excessive abrasion of said coating.

What is claimed is:

1. A process for production of an electrical harness structure, said process comprising;

(a) providing a bundle of electrical conductors comprising a first branch, a second branch and a third branch extending from a node, said electrical conductors comprising wires, said first branch having a first cross section, said second branch having a second cross section, and said third branch having a third cross section wherein said first cross section is smaller than said second cross section which is smaller than said third cross section; and (b) braiding directly on said first, second and third branches extending from said node a first protective braid element, a second protective braid element and a third protective braid element, said first, second and third protective braid elements comprising filaments of a wear-resistant material, wherein:

said first protective braid element leads from said first branch to said third branch and said second branch passes laterally through said first protective braid element, said second protective braid element leads from said second branch to said first branch and said third branch passes laterally through said second protective braid element, said third protective braid element leads from said third branch to said second branch and said first branch passes laterally through said third protective braid element, said braiding of said first, second and third protective braid elements on said first second and third branches is performed by first braiding said first protective braid element on said first and third branches, then braiding said second protective braid element on said first and second branches and then braiding said third protective braid element on said second and third branches, said first, second and third protective braid elements cover, respectively, all of said first, second and third branches, and said first, second and third protective braid elements, respectively, cover partially, in a vicinity of said node, said third, first and second branches; and (c) braiding directly on said bundle a metal sheath element to provide electrical continuity of an electromagnetic shielding system for said bundle.

2. The process as claims in claim 1, further comprising braiding directly on said bundle another protective braid element external to said metal sheath element, said another protective braid element comprising filaments of a wear-resistant material.

3. The process as claimed in claim 1, wherein each of said protective braid elements is formed by:

forming a free braiding tail;

laying the free braiding tail against a corresponding branch of said node;

braiding the protective braid element from said free braiding tail; and securing said free braiding tail in position on the corresponding branch.

* * * * *